US005294334A

United States Patent [19]

Kaul et al.

[11] Patent Number: 5,294,334

[45] Date of Patent: Mar. 15, 1994

[54] BENZENE REMOVAL AND CONVERSION FROM GASOLINE BOILING RANGE STREAMS

[75] Inventors: Bal K. Kaul, Randolph; Donald C. Runaldue, Watchung; Joseph T. O'Bara, Parsippany; Craig Y. Sabottke, Morris Township, Morris County; Edward Niessen, Passaic, all of N.J.

[73] Assignee: Exxon Research and Engineering Company, Florham Park, N.J.

[21] Appl. No.: 17,564

[22] Filed: Feb. 16, 1993

Related U.S. Application Data

[63] Continuation-in-part of Ser. No. 729,678, Jul. 15, 1991, Pat. No. 5,186,819.

[51] Int. Cl.[5] ..... C10G 25/03; C07C 7/13

[52] U.S. Cl. ..... 208/310 Z; 585/827; 585/831; 502/514

[58] Field of Search ..... 208/310 Z; 585/827, 585/831; 502/514

[56] References Cited

U.S. PATENT DOCUMENTS

| | | | |
|---|---|---|---|
| 4,423,280 | 12/1983 | Dessau | 208/310 Z |
| 4,567,315 | 1/1986 | Owaysi et al. | 585/827 |
| 5,186,819 | 2/1993 | Kaul et al. | 585/827 |
| 5,198,102 | 3/1993 | Kaul et al. | 208/310 Z |
| 5,210,333 | 5/1993 | Bellows et al. | 585/831 |

FOREIGN PATENT DOCUMENTS

| | | | |
|---|---|---|---|
| 55-55123 | 4/1980 | Japan | 585/827 |

*Primary Examiner*—R. Bruce Breneman
*Assistant Examiner*—Walter D. Griffin
*Attorney, Agent, or Firm*—Henry E. Naylor

[57] ABSTRACT

A totally contained adsorption process for the substantial total removal and conversion of benzene to cyclohexane in gasoline boiling range streams. At least a portion of the gasoline boiling range stream is passed through an adsorption zone containing an adsorbent which will selectively adsorb benzene from the stream. The process is totally contained in the sense that substantially total conversion of benzene to cyclohexane is achieved without the need for added desorbent. The desorbent is cyclohexane which is generated in the process.

4 Claims, No Drawings

BENZENE REMOVAL AND CONVERSION FROM GASOLINE BOILING RANGE STREAMS

CROSS-REFERENCE TO RELATED APPLICATIONS

This is a continuation-in-part application of U.S. Ser. No. 07/729,678, filed Jul. 15, 1991, now U.S. Pat. No. 5,186,819.

FIELD OF THE INVENTION

The present invention relates to a totally contained adsorption process for the substantial total removal and conversion of benzene to cyclohexane in gasoline boiling range streams. At least a portion of the gasoline boiling range stream is passed through an adsorption zone containing an adsorbent which will selectively adsorb benzene from the stream. The process is totally contained in the sense that substantially total conversion of benzene to cyclohexane is achieved without the need for added desorbent. The desorbent is cyclohexane which is generated in the process.

BACKGROUND OF THE INVENTION

Motor gasolines are undergoing ever changing formulations in order to meet ever restrictive governmental regulations and competition from alternative fuels, such as methanol. One requirement for modern gasolines is that they be substantially benzene free.

While various techniques can be used to selectively remove benzene from gasoline boiling range streams, the use of solid adsorbents, such as molecular sieves, presents advantages over other techniques such as distillation and solvent extraction. Distillation is not suitable primarily because benzene, which has a normal boiling point of about 80° C., forms low boiling azeotropes with normal hexane and naphthenes, such as methyl cyclopentane and cyclohexane. Efficient separation of the benzene from the paraffinic compounds by distillation is not possible because the azeotropes tend to come overhead with the paraffinic compounds. These azeotropes boil in the same range as do normal hexane in a light naphtha cut, i.e., 65° to 70° C. Once the benzene is removed, this separation becomes simple. Extraction with a solvent, such as sulfolane, is technically feasible, but is not as economically attractive as the use of solid adsorbents. Solvents such as sulfolane can introduce sulfur into the gasoline pool, which is unacceptable from an environmental point of view.

Solid adsorbents have been used in the past for removing all aromatics from the non-aromatic fraction of a mixed hydrocarbon stream. For example, U.S. Pat. No. 2,716,144 teaches the use of silica gel for separating all aromatics from gasoline or kerosene fractions. The silica gel containing adsorbed aromatics can then be desorbed with a suitable desorbent, such as an aromatic containing hydrocarbon having a boiling point different than the benzene-containing process stream which is passed over the adsorbent. Other U.S. patents which teach the use of silica gel for adsorbing aromatics from a process stream, followed by desorption by use of a liquid hydrocarbon include U.S. Pat. Nos. 2,728,800; 2,847,485; and 2,856,444.

The separation of aromatics from process streams by use of a molecular sieve is taught in U.S. Pat. No. 3,963,934. In that patent, a 13× molecular sieve is taught to adsorb not only aromatics, but also olefins and sulfur from a $C_5/C_6$ naphtha stream prior to isomerization. U.S. Pat. No. 3,992,469 also teaches the use of molecular sieves for separating all aromatics from process streams. Type X and type Y crystalline aluminosilicates zeolites are taught as preferred molecular sieves. Also, U.S. Pat. No. 4,014,949 discloses that partially hydrated NaY gives a separation factor of 1.6 for benzene (adsorbed) with toluene.

While much work has been done to separate aromatics from non-aromatics in process streams, there is still a need in the art for selectively removing benzene from both the aromatic and non-aromatic components of the stream. The need to remove benzene from gasoline boiling range streams is more critical today in order to meet stringent government requirements.

SUMMARY OF THE INVENTION

In accordance with the present invention, there is provided a process for the substantial removal of benzene and its conversion to cyclohexane in gasoline boiling range process streams. The process comprises:

(a) passing at least a portion of a gasoline boiling range hydrocarbonaceous process stream to an adsorption zone containing a solid adsorbent comprised of an aluminosilicate zeolite material having a silica to alumina ratio of less than about 10, and an average pore diameter greater than the size of the benzene molecule;

(b) passing a desorbent stream containing an effective amount of cyclohexane from a downstream hydrogenation zone, through the bed of benzene-containing adsorbent in the adsorption zone, thereby removing benzene from the adsorbent;

(c) passing the benzene-containing desorbent to a hydrogenation zone to hydrogenate benzene to cyclohexane; and (d) recycling at least a portion of said cyclohexane to the adsorption zone.

In a preferred embodiment of the present invention, only a heart cut fraction of the hydrocarbonaceous process stream is passed to the adsorption zone. Said heartcut fraction will preferably have an average boiling point from about 50° C. to about 90° C., and contain a higher concentration of benzene than the hydrocarbonaceous process stream.

In another preferred embodiment of the present invention, the entire reformate, or hydrocrackate, stream is passed to an adsorption zone and other aromatics, if present, are removed and hydrogenated in a subsequent hydrogenation zone. This will help eliminate aromatics from the gasoline pool.

In another preferred embodiment of the present invention, the zeolite material is a 12 ring or greater zeolite selected from:

(a) Zeolite L framework (code LTL) containing Group IA cations (lithium, sodium, potassium, rubidium, cesium) or mixtures thereof.

(b) Zeolite X framework (code FAU) containing Group IA cations or mixtures thereof.

(c) Zeolite Y framework (code FAU) containing Group IA cations or mixtures thereof.

(d) Zeolite mordenite framework (code MOR) containing Group IA cations or mixtures thereof.

The zeolite framework codes are taken from the publication "The Zeolite Cage Structure" by J. M. Mervsam, Science, Mar. 7, 1986, Volume 231, pp 1093–1099, which is incorporated herein by reference.

In other preferred embodiments of the present invention, the aluminosilicate zeolite material is a NaY zeolite, especially one that is at least partially dehydrated.

In another preferred embodiment of the present invention, the desorbent is a stream which already exists in the refinery or chemical plant which may be passed directly to the adsorption zone.

DETAILED DESCRIPTION OF THE INVENTION

The present invention couples an adsorption zone with a hydrogenation zone in order to substantially totally convert benzene in a gasoline boiling range stream to cyclohexane. The benzene which is adsorbed is desorbed with a stream containing an effective amount of cyclohexane, then passed to the hydrogenation zone where benzene is hydrogenated to cyclohexane. The cyclohexane generated in the hydrogenation zone is used as the desorbent and is passed to the adsorption zone for removal of benzene from the adsorbent. The instant process is totally contained in the sense that the desorbent is generated within the overall process in the hydrogenation zone. There is no need for an external source of desorbent. Furthermore, because substantially all of the benzene is converted to cyclohexane and the cyclohexane is used as the desorbent, there is no need for a downstream separation unit to separate benzene from desorbent.

Process streams on which the present invention can be practiced include those in the gasoline boiling range. In general, the gasoline boiling range can be considered to be in the temperature range of about 27° to 190° C. Preferred process streams include reformates and hydrocrackates, especially reformates.

In the practice of the present invention, a gasoline boiling range process stream is fed to an adsorption zone, which contains a solid adsorbent capable of selectively adsorbing benzene from the stream, even in the presence of other aromatics, such as xylene and toluene, and non-aromatics, such as paraffins. The adsorption zone is operated at any suitable set of conditions, preferably including the temperature of the feedstream, which will typically be from about ambient temperatures (20° C.) to about 150° C. The adsorption zone can be comprised of only one adsorption vessel, or two separate vessels. It can also be comprised of three or more vessels with the appropriate plumbing for continuous adsorption and regeneration of the adsorbent. The adsorption/desorption zone can be run under any suitable mode, examples of which include fixed bed, moving bed, simulated moving bed, and magnetically stabilized bed.

In another preferred mode of operation of the present invention, the process stream is first fractionated so that only a heartcut of said process stream is passed to the adsorption zone. The heartcut fraction will have an average boiling point from about 50° C. to about 90° C., and contains a higher concentration of benzene than the hydrocarbonaceous process stream, is passed to the adsorption zone. The product stream which leaves the adsorption zone is a substantially benzene-free gasoline boiling range stream.

The solid adsorbent is a cation exchanged zeolitic material which is capable of selectivity adsorbing benzene from the stream. Preferably, the zeolite adsorbents of the present invention: (a) have a silica to alumina ratio of less than 10, especially from 1 to 3; (b) an average pore diameter from about 6 to 12 Angstroms (Å), preferably from about 6 to 8 Å; and (c) having a separation factor greater than 1 for benzene versus toluene. That is, it will have a preference for adsorbing benzene than it will for adsorbing toluene. The cation is selected from alkali metals: lithium, sodium, potassium, rubidium and cesium. Preferred is sodium. Preferred cation exchanged zeolites are the 12 ring or greater zeolites. Non-limiting examples of such zeolites include: L-type zeolites, X-type zeolites, Y-type zeolites, and mordenite type zeolites, all of which contain one or more different Group IA cation. By "L-type" zeolite is meant those zeolites which are isostructual zeolite L. The same holds true for the X-type, Y-type, and mordenite-type. That is, the X-type zeolites are isostructual to zeolite X, etc.

More preferred is NaY. Especially preferred zeolites are those that are at least partially dehydrated. They can be dehydrated by calcining them at an effective temperature and for an effective amount of time. Effective temperatures will generally be from about 90° C. to 150° C., preferably from about 150° C. to 200° C., and more preferably from about 200° C. to 260° C. An effective amount of time will be for a time which will be effective at reaching the desired level of dehydration at the temperature of calcination. Generally this amount of time will be from 1 to 4 hours, preferably from about 2 to 3 hours.

The solid adsorbent is regenerated by treating it with a suitable desorbent stream which is generated in the downstream hydrogenation zone and which contains an effective amount of cyclohexane. By effective amount of cyclohexane, we mean that the stream is cyclohexane. That is, it contains excess amount of cyclohexane. By practice of the present invention, there is no need for a downstream separation unit for the separation of benzene from the desorbent, because substantially all of the benzene is converted to cyclohexane—the desorbent. The desorbed benzene and desorbent are cycled to the hydrogenation zone where the benzene is converted to cyclohexane.

The hydrogenation can be accomplished by any suitable means for converting benzene to cyclohexane. The hydrogenation zone can also be referred to as the dearomatization zone. The hydrogenation of benzene to cyclohexane is typically a catalytic process conducted at elevated temperatures and pressures. Catalysts suitable for this hydrogenation process are comprised of an active metal on a refractory support. The active metal is preferably selected from the group consisting of metals from Group VIII, more preferably Ni, Co, and Pt; and Group IB, preferably Cu. A promoter metal such as Mo and/or W can also be used. The Groups referred to are from the Periodic Table of the Elements, such as the one illustrated on page 662 of *The Condensed Chemical Dictionary*, ninth edition, Van Norstrand Reinhold Co., 1977. The refractory support material may be any of those suitable as catalyst supports. Non-limiting examples of such materials include carbon, alumina, and silica-based materials, such as kieselguhr. It will also be noted that non-pyrophoric non-supported catalysts may also be used, such as Raney nickel. Typical hydrogenation temperatures range from about 50° C. to 300° C., preferably from about 75° C. to 250° C., and more preferably from about 100° C. to 225° C. Pressures will range from about 10 to 50 atmospheres, preferably from about 15 to 35 atmospheres.

At least a portion of the product stream from the hydrogenation zone is passed to the adsorption zone where it contacts the benzene-containing adsorbent and desorbs the benzene. The desorbent can be either a liquid or vapor, with liquid being preferred.

The desorbent, which now carries the desorbed benzene, leaves the adsorption zone and is passed to a hydrogenation zone where the benzene of the stream is dearomatized to cyclohexane.

Having thus described the present invention, and preferred embodiments thereof, it is believed that the same will become even more apparent by the examples to follow. It will be appreciated, however, that the examples are for illustrative purposes and are not intended to limit the invention.

EXAMPLE 1

Various cation-exchanged forms of zeolite L powder were contacted at 25° C. in sealed vials with a hydrocarbon mixture which contained 3.0 g. of benzene, 3.0 g. of toluene, 60.0 g. of decalin and 2.0 g. of tri-tertiarybutyl benzene. The contacting was carried out by shaking the vials for a period of over 4 hours. This was long enough for the zeolite and hydrocarbon phases to come to equilibrium. The hydrocarbon phase was analyzed by gas chromatography before and after contacting with the zeolite. From the analyses, calculations were made of the zeolite separation factor for benzene versus toluene, and the zeolite capacity to adsorb benzene plus toluene.

Separation factor is defined as $$\propto B/T = \frac{[(\text{benzene})/(\text{toluene})]\text{in zeolite}}{[(\text{benzene})/(\text{toluene})]\text{in solution}}$$

at equilibrium. Capacity is defined as weight percent benzene plus toluene on zeolite at equilibrium.

The following results were obtained:

TABLE I

| Zeolite | Si:Al Ratio | Capacity, Weight % | Separation Factor ∝B/T |
|---|---|---|---|
| LiL | 2.6 | 8 | 1.3 |
| KL | 2.6 | 2 | 1.6 |

This example shows that LiL and KL zeolites show a separation factor in favor of benzene adsorption over toluene, i.e., $\propto B/T > 1.0$.

EXAMPLE 2

The experiment of Example 1 was repeated using various cation-exchanged forms of zeolite X powder. The results obtained are shown in Table II.

TABLE II

| Zeolite | Si:Al Ratio | Capacity, Weight % | Separation Factor ∝B/T |
|---|---|---|---|
| LiX | 1.5 | 7 | 5.5 |
| NaX | 1.0 | 20 | 1.4 |
| NaX | 1.5 | 18 | 1.0 |
| NaRbX | 1.5 | 6 | 10.0 |
| NaCsX | 1.5 | 8 | 3.0 |
| MgX | 1.5 | 14 | 1.4 |

This example shows that a number of X-type zeolites show a separation factor in favor of benzene adsorption in preference to toluene.

EXAMPLE 3

The experiment of Example 1 was repeated using various cation-exchanged forms of zeolite Y powder. The results obtained are shown in Table III.

TABLE III

| Zeolite | Si:Al Ratio | Capacity, Weight % | Separation Factor ∝B/T |
|---|---|---|---|
| LiY | 2.5 | 28 | 1.6 |
| KY | " | 17 | 1.5 |
| NaY | " | 17 | 2.9 |
| MgY | " | 19 | 1.2 |
| LiNaY | " | 15 | 1.3 |
| CsKY | " | 6 | 1.6 |
| RbKY | " | 16 | 1.2 |
| LiKY | " | 24 | 1.7 |
| NaLaY | " | 21 | 1.3 |

This example shows that a range of Y zeolites gives a selective separation of benzene versus toluene by adsorption. It also shows that Y zeolite, with mixed cations, shows a preference to adsorb benzene over toluene. Furthermore, the data show that NaY zeolite has a very favorable combination of capacity and separation factor.

EXAMPLE 4

The experiment of Example 1 was repeated using various cation-exchanged forms of zeolite Mordenite. The results obtained are shown in Table IV.

TABLE IV

| Zeolite | Si:Al Ratio | Capacity Weight % | Separation Factor ∝B/T |
|---|---|---|---|
| Li MOR | 6.2 | 6 | 1.9 |
| Cs MOR | 6.2 | 8 | 1.6 |

This example shows that mordenites also preferentially adsorb benzene over toluene.

COMPARATIVE EXAMPLE

The experiment of Example 1 was followed except several other zeolites were used. The zeolites used and the results obtained are shown in Table V.

TABLE V

| Zeolite | Si:Al Ratio | Capacity, Weight % | Separation Factor ∝B/T |
|---|---|---|---|
| ZSM-5 | 3 | 5 | 0.33 |
| $Cu^{+2}Y$ | 2.5 | 8 | 0.38 |
| LiLZ-210 | ~5 | 16 | ~1 |
| BaECR-32* | ~6 | 16 | ~0.6 |

*ECR-32 is a faujasite type of zeolite and its description is found in U.S. Pat. No. 4,931,267 which is incorporated herein by reference.

The above table evidences that not all zeolites are selective for the adsorption of benzene over toluene.

EXAMPLE 5

A light reformate refinery stream was passed through an adsorption column comprised of a bed of 300 g. NaX zeolite adsorbent at room temperature (72° F.). Samples of treated feed, as they exited the column, were analyzed in time intervals indicated in Table VI below for the individual components of the feed.

TABLE VI

| Time, Min. | Benzene, Wt. % | Paraffins Wt. % |
|---|---|---|
| 5 | 0 | 100 |
| 10 | 0 | 100 |
| 15 | 0 | 100 |
| 18 | 6.33 | 93.67 |
| 20 | 14.39 | 85.61 |
| 22 | 20.86 | 79.14 |
| 24 | 22.62 | 77.38 |
| 30 | 23.12 | 76.88 |

TABLE VI-continued

| Time, Min. | Benzene, Wt. % | Paraffins Wt. % |
|---|---|---|
| 35 | 23.18 | 76.88 |

The adsorbent was desorbed by passing dearomatized benzene, which contains an excess amount of cyclohexane, through the bed of adsorbent at a flow rate of 20 cc/min and the concentration of benzene was monitored at the time intervals set forth in Table VII below.

TABLE VII

| Time, Min. | Benzene, Wt. % |
|---|---|
| 10 | 23.18 |
| 12 | 18.76 |
| 14 | 8.58 |
| 16 | 5.18 |
| 20 | 3.71 |
| 30 | 2.67 |
| 40 | 1.63 |
| 190 | 1.19 |
| 215 | 0.31 |
| 240 | 0.0 |

EXAMPLE 6

A sample of NaY zeolite was fully saturated with water by keeping it over a saturated solution of NaCl in a desiccator for 4 days. The sample was then calcined at a temperature of 100° C. for 2 hours and a portion was taken for benzene adsorption experiments, which will be discussed below. The remainder of the zeolite sample was then calcined at 200° C. for 2 hours and a sample taken for a benzene adsorption experiment. This procedure was repeated at 300° C., 400° C., and 500° C. The benzene adsorption experiments were conducted on a model mixture comprised of 60.06 g. of decalin(cis) as a solvent, 2.02 g. of tritertiary butyl benzene (TTBB) as an unadsorbed internal standard for gas chromatograph analyses, 3.03 g. benzene, and 3.02 g. toluene. This represented a 1/1 benzene/toluene mix. The pure liquids used to prepare the model mixture were dried thoroughly over zeolite 4A pellets and the TTBB, which was a solid, was dried for one hour in a hot air oven at 35° C. The calcined zeolite samples were dried for 4 hours at 400° C. then transferred to a desiccator at 130° C. which had been purged with dry nitrogen. All weighing of zeolite samples were carried out in balance case free of atmospheric moisture. New air tight vials were used to contain the zeolite and solution phase. The model mixture was contacted with the zeolite sample overnight at room temperature(about 22° C.). The model mixture phase and the zeolite phase were separated by filtration and a gas chromatographic analysis was performed using the TTBB as the internal standard. The results of benzene adsorption are shown in Table VIII below.

TABLE VIII

| Calcination Temperature ° C. | Benzene + Toluene Wt. % Adsorbed | Separation Factor $\alpha$ B/T |
|---|---|---|
| 100 | 9.4 | 1.3 |
| 200 | 18.8 | 2.7 |
| 300 | 18.6 | 2.7 |
| 400 | 17.3 | 2.9 |

TABLE VIII-continued

| Calcination Temperature ° C. | Benzene + Toluene Wt. % Adsorbed | Separation Factor $\alpha$ B/T |
|---|---|---|
| 500 | 17.8 | 2.8 |

EXAMPLE 7

The above conditions for the adsorption experiments were used to test the adsorption characteristics of NaY and NaX for selectively removing benzene from a model mixture containing benzene (B), toluene (T), and 1-methyl naphthalene (1-MN). The results are shown in Table IX below.

TABLE IX

| Zeolite | Benzene + Toluene + 1-Methyl Napththalene, Wt. % Absorbed | Separation Factor B/T | Separation Factor B/1-MN |
|---|---|---|---|
| NaX | 16.1 | 1.2 | 1.4 |
| NaY | 25.7 | 2.3 | 11.1 |

The above table shows that NaY zeolite is superior to NaX zeolite for selectively removing benzene over 1-methyl naphthalene. Benzene and 1-methyl naphthalene compete approximately equally for NaX zeolite. These results are evidence that NaY zeolite is an absorbent of choice for benzene separation from a refinery stream which contains some alky naphthalenes, such as a reformate stream.

What is claimed:

1. A process for selectively removing benzene from gasoline boiling range process streams, which process comprises:
   (a) passing at least a portion of a gasoline boiling range hydrocarbonaceous process stream to an adsorption zone containing a solid adsorbent comprised of an aluminosilicate zeolite material having a silica to alumina ratio of less than about 10, and an average pore diameter greater than the size of the benzene molecule;
   (b) passing a desorbent stream containing an effective amount of cyclohexane from a downstream hydrogenation zone, through the bed of benzene-containing adsorbent in the adsorption zone, thereby removing benzene from the adsorbent;
   (c) passing the benzene-containing desorbent to a hydrogenation zone to hydrogenate benzene to cyclohexane; and
   (d) recycling at least a portion of said cyclohexane to the adsorption zone.

2. The process of claim 1 wherein the solid adsorbent is a 12 ring, or greater, zeolite material selected from the cation-exchanged: L-type zeolites, X-type zeolites, Y-type zeolites, and mordenite-type zeolites; and wherein one or more of the cations is selected from the group consisting of: lithium, sodium, potassium, rubidium, and cesium.

3. The process of claim 1 wherein the gasoline boiling range hydrocarbonaceous process stream is first fractionated to produce a heartcut fraction having an average boiling point from about 50° to 90° C., and which contains a higher concentration of benzene than the non-fractionated hydrocarbonaceous process stream, wherein only the heartcut is passed to the adsorption zone.

4. The process of claim 1 wherein the adsorption/desorption zone is run in a mode selected from fixed bed, moving bed, simulated moving bed, and magnetically stabilized bed.

* * * * *